US009289025B2

(12) United States Patent
Damodar

(10) Patent No.: US 9,289,025 B2
(45) Date of Patent: Mar. 22, 2016

(54) FLAT-TO-HEEL CONVERTIBLE OUTSOLE

(71) Applicant: Aashika Damodar, Washington, DC (US)

(72) Inventor: Aashika Damodar, Washington, DC (US)

( * ) Notice: Subject to any disclaimer, the term of this patent is extended or adjusted under 35 U.S.C. 154(b) by 110 days.

(21) Appl. No.: 14/167,866

(22) Filed: Jan. 29, 2014

(65) Prior Publication Data

US 2014/0208620 A1 Jul. 31, 2014

Related U.S. Application Data

(60) Provisional application No. 61/757,795, filed on Jan. 29, 2013.

(51) Int. Cl.
*A43B 3/24* (2006.01)
*A43B 21/36* (2006.01)

(52) U.S. Cl.
CPC ..... *A43B 3/246* (2013.01); *A43B 21/36* (2013.01)

(58) Field of Classification Search
CPC ..... A43B 3/246; A43B 3/248; A43B 21/36; A43B 21/48; A43B 21/51; A43B 21/42
USPC ..... 36/42, 36 R, 41
See application file for complete search history.

(56) References Cited

U.S. PATENT DOCUMENTS 1,715,588 A * 6/1929 Bowen ..... 36/42
1,743,543 A * 1/1930 Gutierrez ..... 36/42
3,805,418 A * 4/1974 Matuka et al. ..... 36/34 A
3,918,754 A * 11/1975 Isbister ..... 292/224
4,805,320 A * 2/1989 Goldenberg et al. ..... 36/42
5,079,857 A * 1/1992 Clifton ..... 36/42
5,133,138 A * 7/1992 Durcho ..... 36/36 R
5,309,651 A * 5/1994 Handel ..... 36/100
5,524,365 A * 6/1996 Goldenberg ..... 36/42
5,596,819 A * 1/1997 Goldston et al. ..... 36/35 R
8,281,503 B2 * 10/2012 Savill, Jr. ..... 36/100
8,322,053 B2 * 12/2012 Handel et al. ..... 36/100
2001/0030215 A1 * 10/2001 Vincenzo ..... 224/435
2003/0172494 A1 * 9/2003 Oshima et al. ..... 16/285
2004/0089562 A1 * 5/2004 Book ..... 206/214
2004/0182879 A1 * 9/2004 Kingsland et al. ..... 221/263
2005/0172981 A1 * 8/2005 Byun ..... 132/287
2007/0278253 A1 * 12/2007 Ruiz De Gopegui et al. ..... 222/402.13
2007/0278760 A1 * 12/2007 VanBelle et al. ..... 280/166
2008/0128451 A1 * 6/2008 Krauth et al. ..... 221/63
2008/0184598 A1 * 8/2008 Handel et al. ..... 36/100
2008/0316171 A1 * 12/2008 Shahoian et al. ..... 345/158
2010/0055641 A1 * 3/2010 Terauchi ..... 433/75
2010/0083537 A1 * 4/2010 Wierda et al. ..... 36/100
2010/0139123 A1 * 6/2010 Alan et al. ..... 36/100
2011/0032187 A1 * 2/2011 Kramer et al. ..... 345/163

(Continued)

*Primary Examiner* — Khoa Huynh
*Assistant Examiner* — Jocelyn Wu

(57) ABSTRACT

A flat-to-heel convertible outsole allows a user to transition from a flat-bottom, low-wedge shoe style to a high-heel shoe style. A collapsible heel includes an upper heel, a lower heel, and a heel pin. The upper heal is connected to an arch platform in order to form a single foot supporting structure. The heel pin is hingedly connected to the upper heel, while the lower heel is telescopically connected to the heel pin opposite the upper heel. In this way, the lower heel can be positioned in an extended configuration or a stowed configuration. When in the extended configuration, a locking mechanism connected to the lower heel engages a lock notch of the upper heel in order to secure the lower heel to the upper heel. When in the stowed configuration, the lower heel is positioned within a heel recess that traverses into the arch platform.

18 Claims, 19 Drawing Sheets

SECTION B-B

SECTION D-D

(56) References Cited

U.S. PATENT DOCUMENTS

2011/0067265 A1* 3/2011 Green ..... 36/42
2011/0197474 A1* 8/2011 Mahmoud ..... 36/100
2011/0230077 A1* 9/2011 Amidon ..... 439/345
2012/0055048 A1* 3/2012 Haupt et al. ..... 36/34 R
2012/0084992 A1* 4/2012 Shin et al. ..... 34/82
2012/0186105 A1* 7/2012 Kemp et al. ..... 36/100
2012/0267398 A1* 10/2012 Lim ..... 222/256
2013/0019498 A1* 1/2013 Causey et al. ..... 36/42
2013/0062231 A1* 3/2013 Angiulo et al. ..... 206/278
2013/0160332 A1* 6/2013 Yoon ..... 36/36 R
2013/0206619 A1* 8/2013 Angiulo et al. ..... 206/278
2013/0247412 A1* 9/2013 Du Coeur ..... 36/42
2013/0248531 A1* 9/2013 Lane ..... 220/262
2013/0333246 A1* 12/2013 Weller et al. ..... 36/103
2014/0088504 A1* 3/2014 King ..... 604/131
2014/0096413 A1* 4/2014 Anderson ..... 36/100
2014/0207056 A1* 7/2014 Bono et al. ..... 604/34
2014/0259777 A1* 9/2014 Morris Thill ..... 36/100
2014/0283416 A1* 9/2014 Yamada et al. ..... 36/34 R
2014/0298685 A1* 10/2014 Alan et al. ..... 36/100

* cited by examiner

SECTION A-A

SECTION B-B

SECTION C-C

SECTION D-D

FLAT-TO-HEEL CONVERTIBLE OUTSOLE

The current application claims a priority to the U.S. Provisional Patent application Ser. No. 61/757,795 filed on Jan. 29, 2013.

FIELD OF THE INVENTION

The present invention relates generally to footwear. More specifically, the present invention is a convertible outsole that is attached to a conventional shoe body. Furthermore, the present invention allows for the transition between a flat-bottom, low-wedge shoe style and a high-heel shoe style through retractable heel portion.

BACKGROUND OF THE INVENTION

Many women favor high-heeled footwear to complement their outfits as the footwear has proven to be fashionable and elegant. Wearing high-heeled footwear provides women with several aesthetic benefits. Women appear taller with their legs appearing longer and more slender when wearing high-heeled footwear. Additionally, wearing high-heeled footwear alters a woman's posture into a form that is generally considered to be more attractive. However, despite its aesthetic appeal and benefits, high-heeled footwear is a leading cause of many podiatric ailments. The positioning of the ankle at a higher height than that of the toes causes great pain in a woman's foot while the increased height and imbalance increases the likelihood of falling and spraining or fracturing the ankle. Additionally, women who frequently wear high-heeled footwear are subject to increased stress in their knees, resulting in problems with the knee joints. The present invention seeks to address the aforementioned issues faced by women who wear high-heeled footwear.

It is therefore the object of the present invention to provide women with a means of enjoying the benefits of wearing high-heeled footwear while wearing a conventional shoe. The present invention is a convertible outsole that is attached to a conventional shoe body. An upper heel is connected to an arch platform in order to form a foot supporting structure. A lower heel is pivotally connected to the upper heel by means of a heel pin positioned within both the upper heel and the lower heel. The lower heel is adjustable between two positions through the heel pin. When in an extended configuration, a locking mechanism connected to the lower heel engages the upper heel in order to lock and secure the lower heel to the upper heel. This allows the present invention to be used as a high-heel style shoe. In a stowed configuration, the lower heel is rotated into a heel recess along the bottom of the arch platform, such that the present invention can be used as a flat-bottom, low-wedge style shoe. The present invention allows women to experience the aesthetic appeal and benefits of wearing high-heeled footwear while providing the option of converting their shoes to conventional flat soled footwear as needed, and thus provides women with greater flexibility when choosing footwear. Additionally, the present invention is capable of greatly reducing foot discomfort and potential injury as women may simply retract the heel insert as necessary and utilize the present invention as a conventional flat soled shoe.

DETAIL DESCRIPTIONS OF THE INVENTION

All illustrations of the drawings are for the purpose of describing selected versions of the present invention and are not intended to limit the scope of the present invention.

The present invention is a flat-to-heel convertible outsole for footwear. The flat-to-heel convertible outsole is connected to a shoe body and allows a user to transition from a flat-bottom, low-wedge shoe style to a high-heel shoe style. The present invention is used in conjunction with an upper in order to form a complete shoe. The upper is shaped to connect around the top perimeter of the present invention and is flexible as to appropriately contour to the user's foot when transitioning between different shoe styles.

Figure 1:
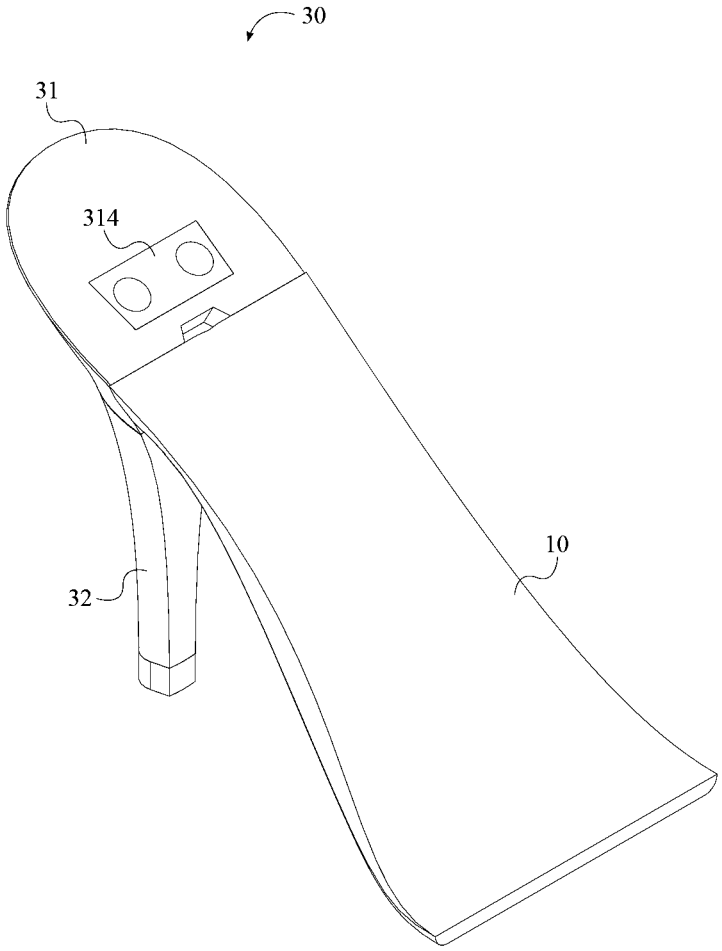
FIG. 1 is a perspective view of the present invention.
Figure 2:
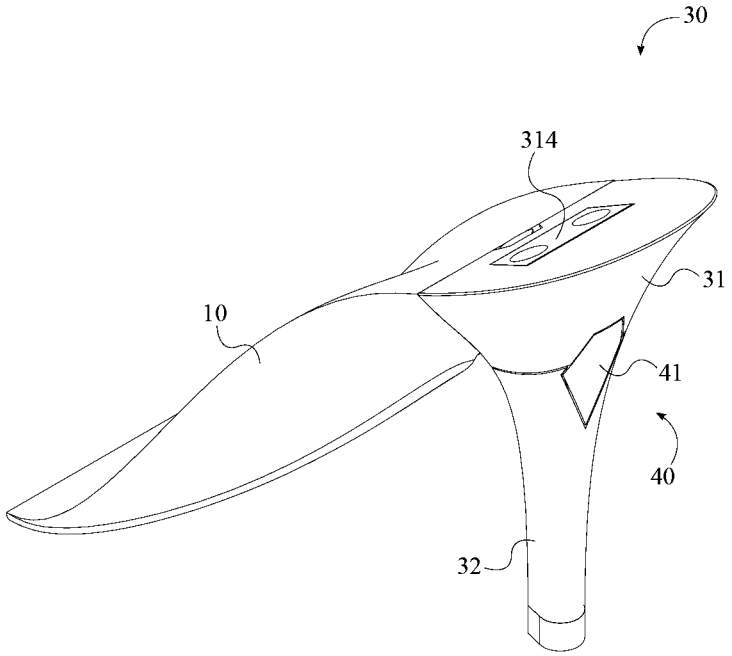
FIG. 2 is a perspective view showing the lower heel in the extended configuration.
Figure 6:
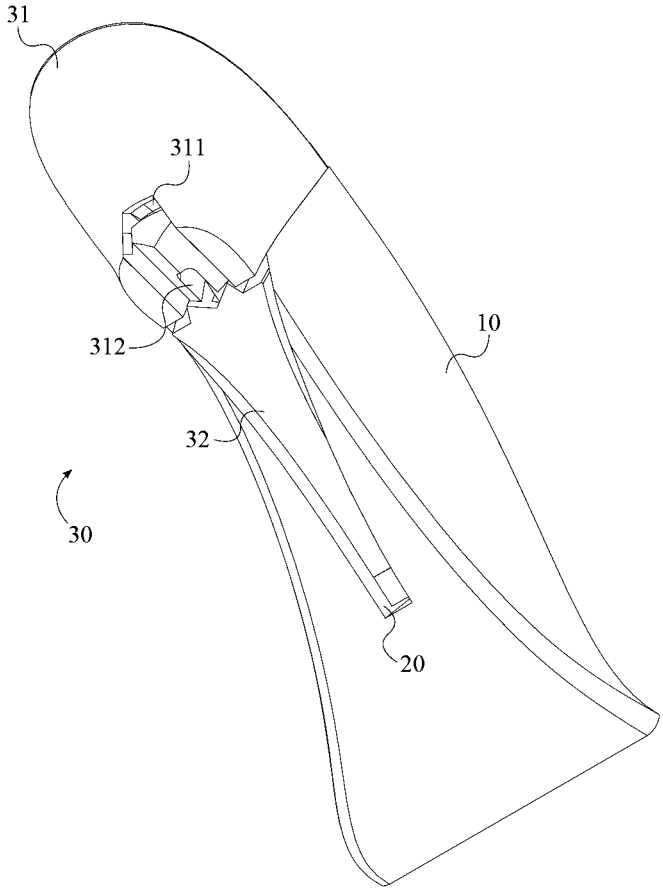
FIG. 6 is a perspective view showing the lower heel positioned within the heel recess.
Figure 7:
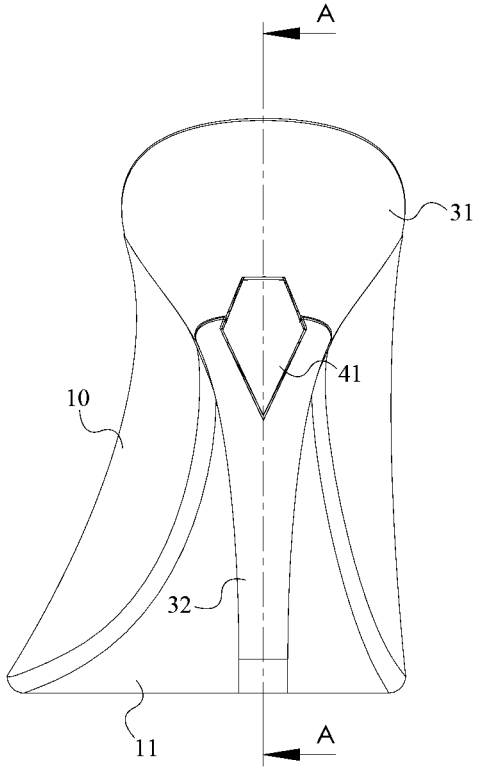
FIG. 7 is a rear elevational view showing the lower heel in the extended configuration.

In reference to FIGS. 1-2 and FIG. 6, the flat-to-heel convertible outsole comprises an arch platform 10, a heel recess 20, a collapsible heel 30, and a locking mechanism 40. The arch platform 10 comprises an outsole bottom surface 11 that is the surface along which the arch platform 10 contacts the ground. As such, the outsole bottom surface 11 may be designed to provide a desired traction. The heel recess 20 traverses through the outsole bottom surface 11 and into the arch platform 10, thus forming an empty space along the bottom of the arch platform 10. The heel recess 20 is positioned along the arch platform 10 and is aligned with the collapsible heel 30 such that a portion of the collapsible heel 30 may be enclosed when folded into the heel recess 20. The upper heel 31 is connected to the arch platform 10 and positioned adjacent to the heel recess 20; the arch platform 10 supporting the arch portion of the user's foot and the collapsible heel 30 supporting the heel portion of the user's foot.

Figure 3:
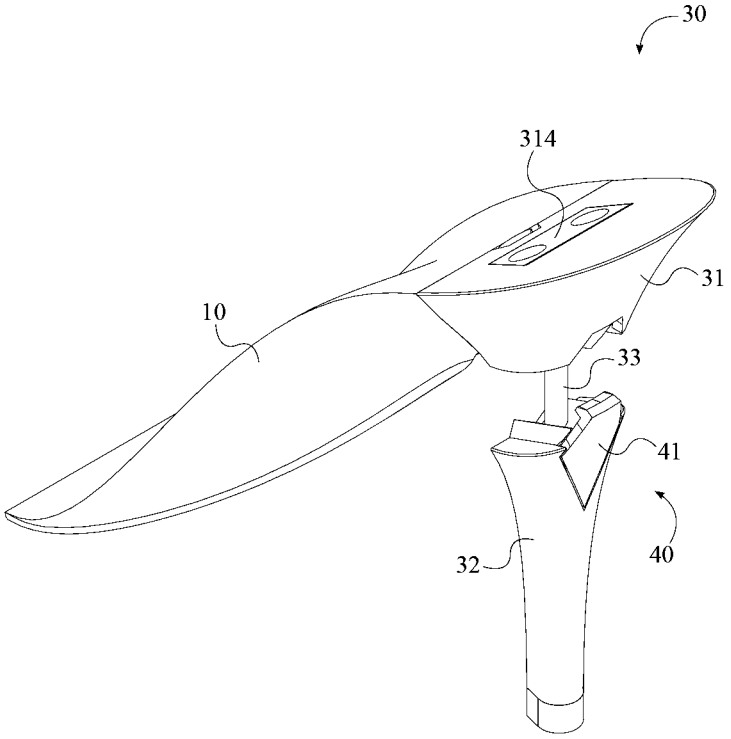
FIG. 3 is a perspective view showing the lower heel extended downwards along the heel pin.
Figure 4:
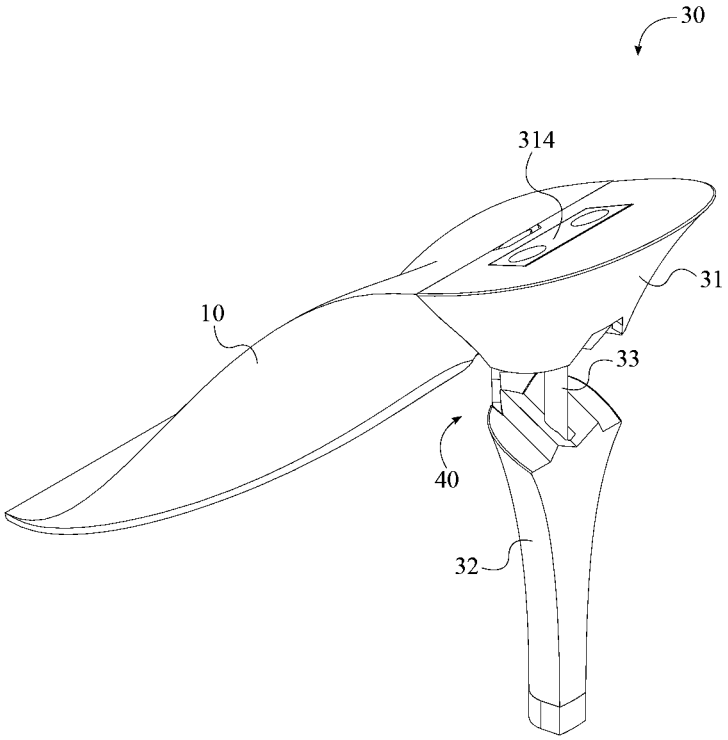
FIG. 4 is a perspective view showing the lower heel extended downwards and rotated one hundred eighty degrees.

In reference to FIG. 3-4, the collapsible heel 30 comprises an upper heel 31, a lower heel 32, and a heel pin 33. The heel pin 33 is hingedly connected to the upper heel 31, while the lower heel 32 is telescopically attached to the heel pin 33 opposite the upper heel 31. In this way, the lower heel 32 can be bistably positioned into either an extended configuration or a stowed configuration in order to transition from a high-heel shoe style to a flat-bottom, low-wedge shoe style, and vice versa. When in the stowed configuration, the heel pin 33 is pivoted upwards, towards the upper heel 31 and the lower heel 32 is positioned into the heel recess 20, as shown in FIG. 6. The locking mechanism 40 is connected to the lower heel 32 and is positioned adjacent to the upper heel 31, such that the locking mechanism 40 binds the lower heel 32 to the upper heel 31 when the lower heel 32 is in the extended configuration. The lower heel 32 may vary in size and shape according to the various lengths, styles, and sizes of conventional high-heeled footwear.

Figure 8:
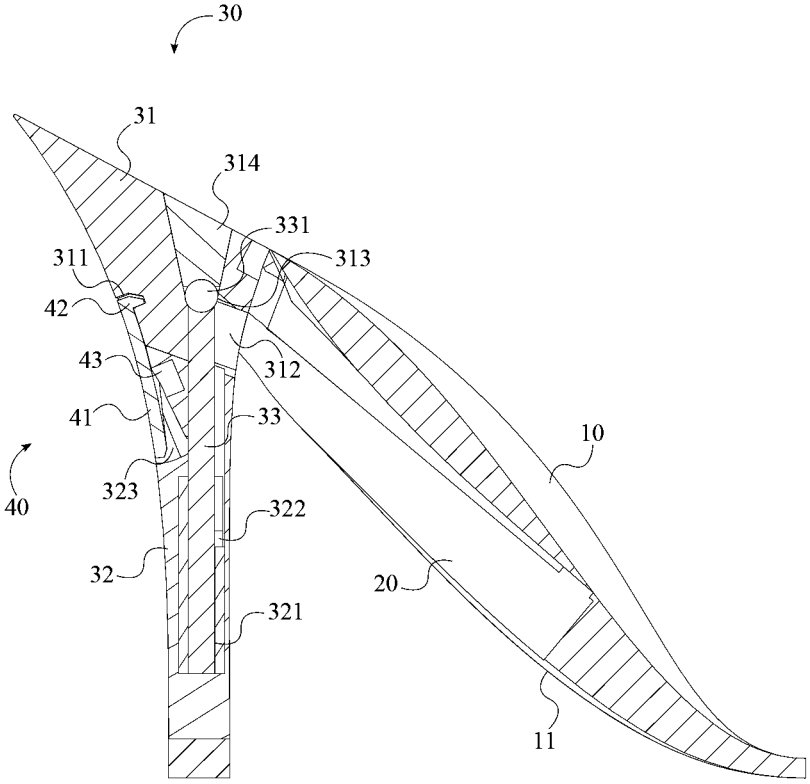
FIG. 8 is a left side sectional view thereof.
Figure 9:
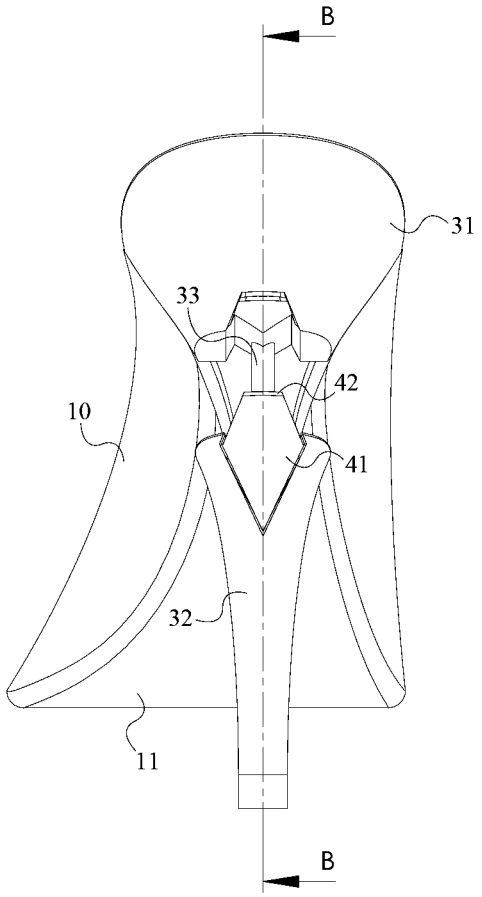
FIG. 9 is a rear elevational view showing the lower heel extended downwards along the heel pin.
Figure 10:
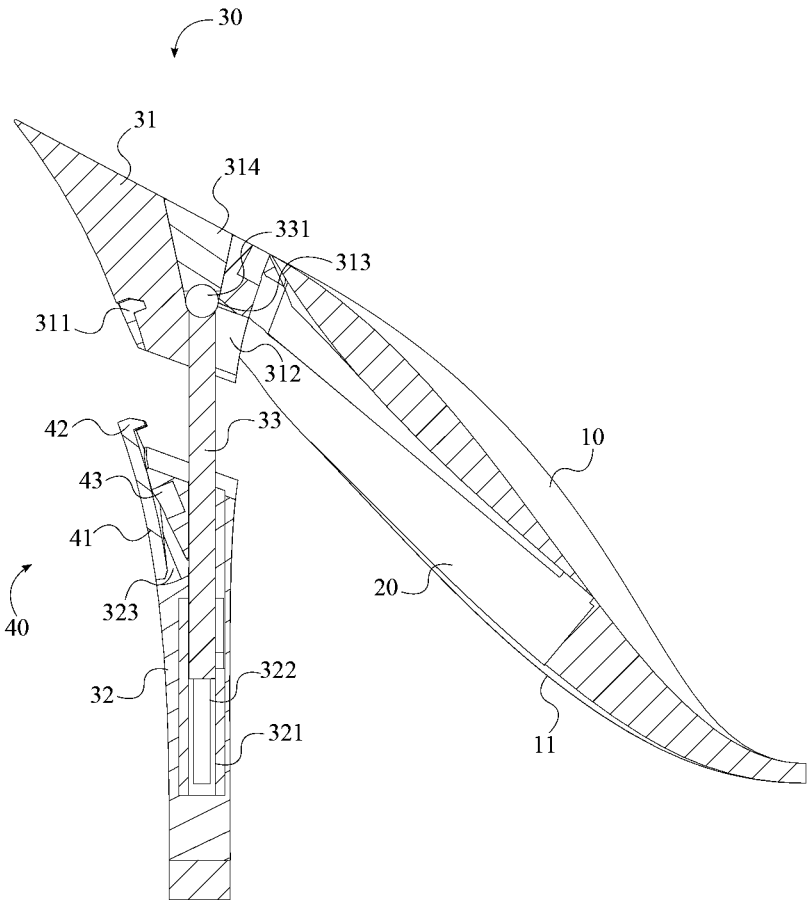
FIG. 10 is a left side sectional view thereof.
Figure 11:
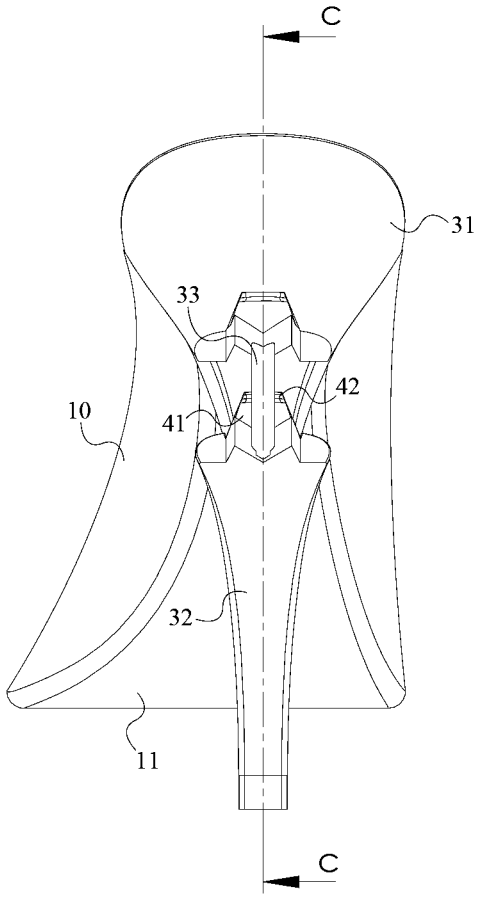
FIG. 11 is a rear elevational view showing the lower heel extended downwards and rotated one hundred eighty degrees.
Figure 12:
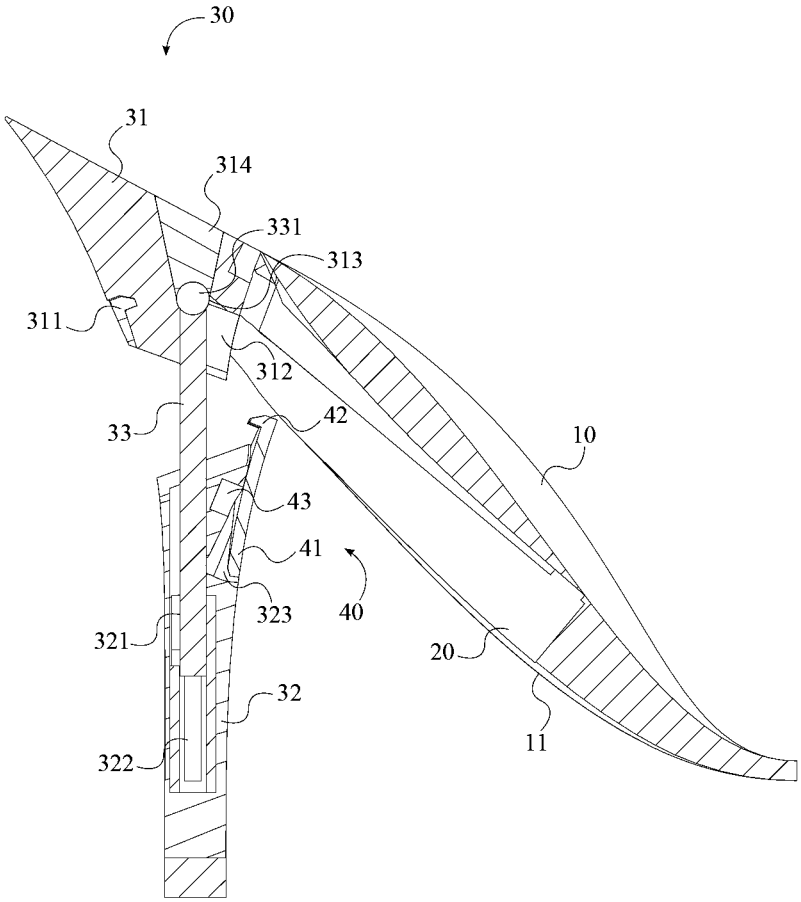
FIG. 12 is a left side sectional view thereof.
Figure 13:
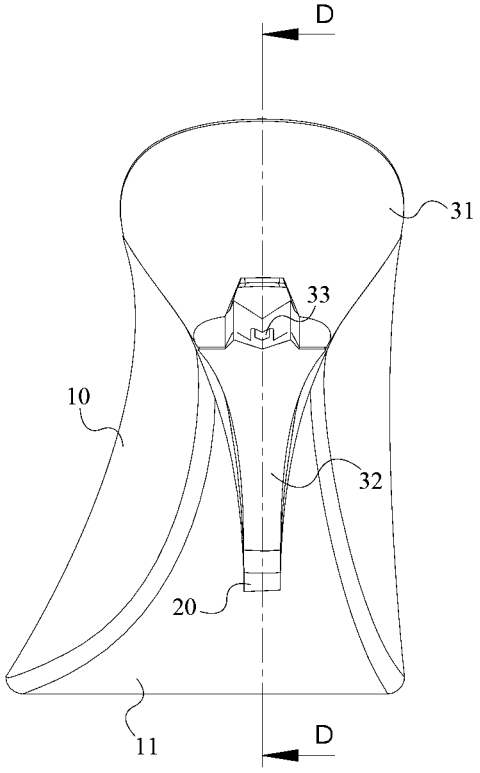
FIG. 13 is a rear elevational view showing the lower heel in the stowed configuration.
Figure 14:
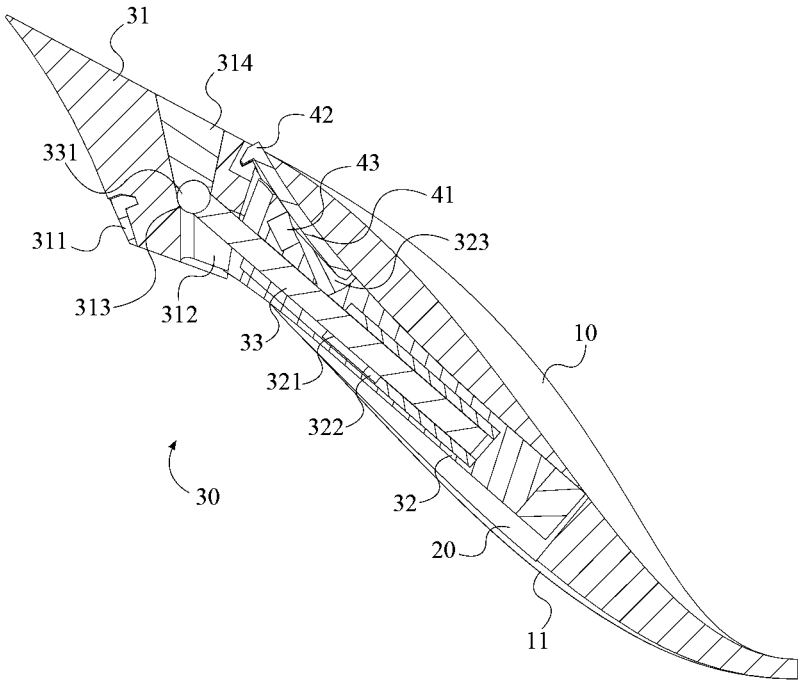
FIG. 14 is a left side sectional view thereof.
Figure 15:
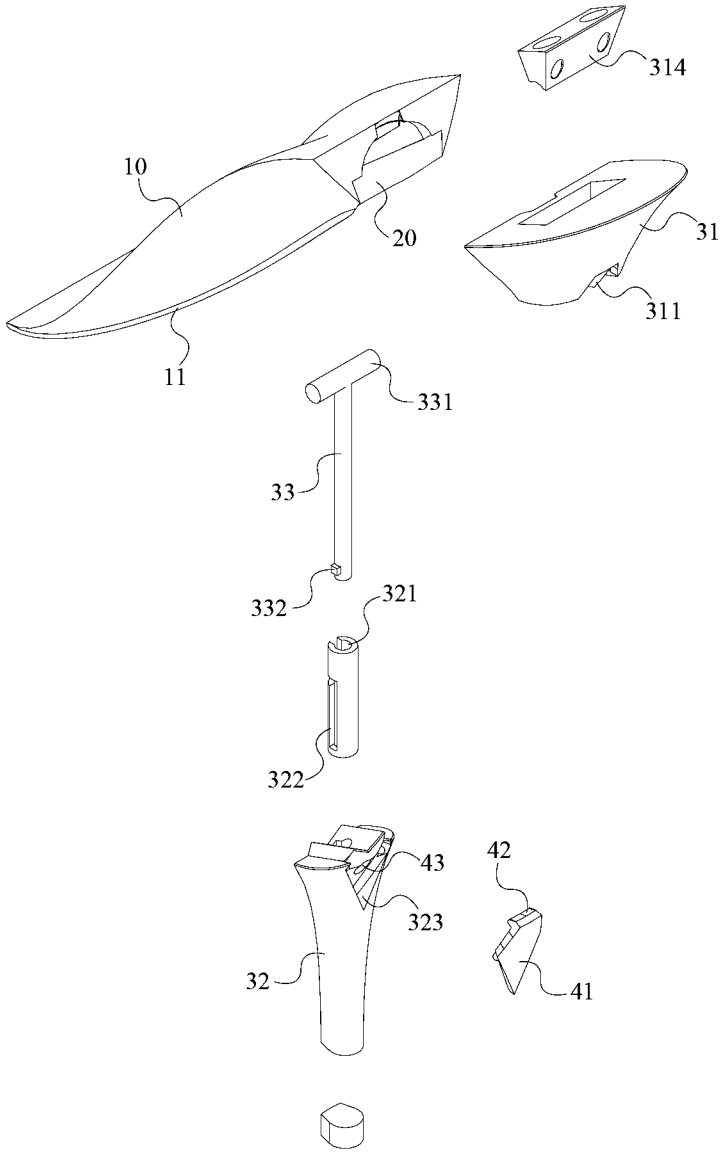
FIG. 15 is an exploded view of the present invention.
Figure 16:
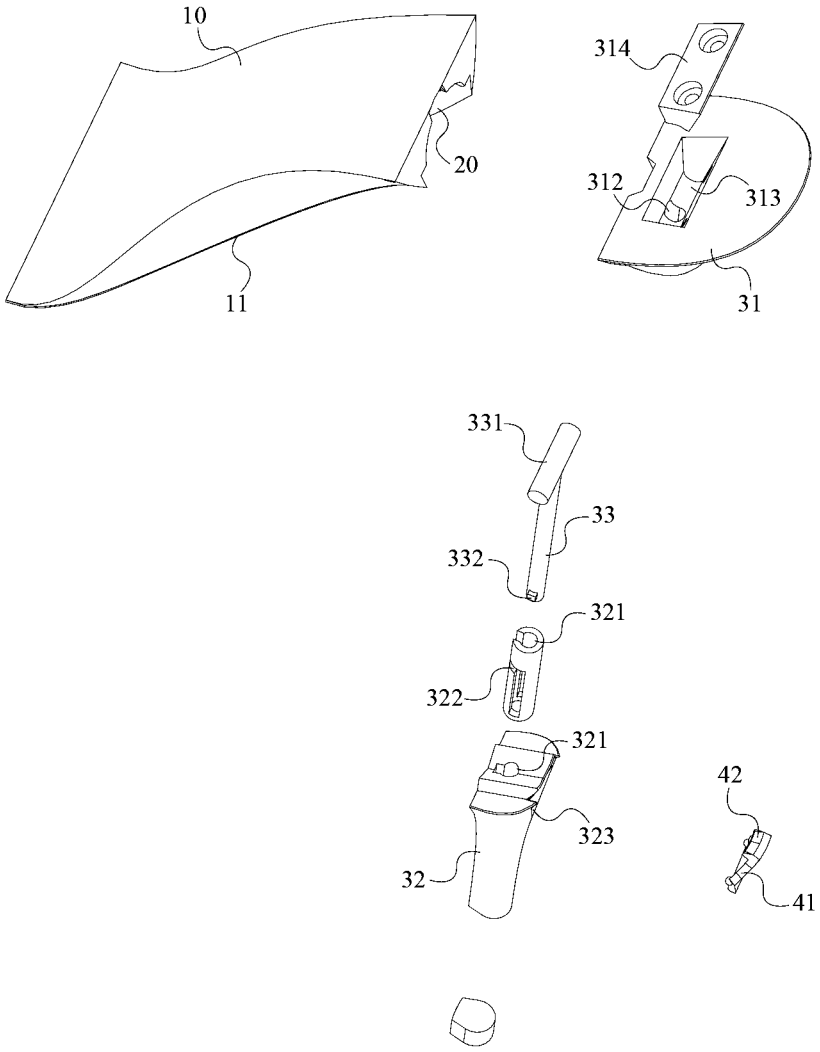
FIG. 16 is a second exploded view of the present invention.

In reference to FIG. 8 and FIG. 15-16, the upper heel 31 comprises a pin cavity 312, a pin cradle 313, and a pin stop 314. The pin cavity 312 is positioned adjacent to the heel recess 20 and forms an empty space in the upper heel 31 through which the heel pin 33 may traverse. The pin cradle 313 is an annular cavity that is positioned adjacent to the pin cavity 312. The heel pin 33 comprises a support arm 331, which is an annular extrusion that is positioned perpendicular to the main shaft of the heel pin 33. The support arm 331 rests in the pin cradle 313 and allows the heel pin 33 to pivot about a single axis. It is possible for the pin cradle 313 or the support arm 331 to be ratcheted in order to regulate the rotation of the heel pin 33. In the preferred embodiment of the present invention, the heel pin 33 is positioned through a top opening in the upper heel 31 and into the pin cradle 313. The pin stop 314 is then positioned into the top opening, over the support arm 331, while a pair of screws secure the pin stop 314 to the upper heel 31. The pin stop 314 can also be secured to the upper heel 31 using an adhesive, snap fit connection, etc.

In further reference to FIG. 8 and FIG. 15-16, the lower heel 32 comprises a pin channel 321 and a pin guide 322. The pin channel 321 traverses along the lower heel 32, down from the upper heel 31, and is the empty space into which the heel pin 33 is positioned. The pin guide 322 directs the movement of the lower heel 32 about the heel pin 33 and is positioned within the lower heel 32, adjacent to the pin channel 321. The heel pin 33 further comprises a nub 332; the support arm 331 and the nub 332 being positioned opposite each other along the heel pin 33. The nub 332 slidably engages the pin guide 322 in order to limit the directional movement of the lower heel 32 along the heel pin 33. In the preferred embodiment of the present invention, the pin guide 322 is a U-shaped track that allows the lower heel 32 to be slid downwards along the heel pin 33, rotated one hundred eighty degrees, and then slid upwards along the heel pin 33. Additionally, the lower heel 32 can be removed for maintenance or to be replaced by sliding the lower heel 32 downwards along the heel pin 33, rotating the lower heel 32 ninety degrees, and then continuing to slide the lower heel 32 downwards along the heel pin 33.

In reference to FIG. 8 and FIG. 15, the lower heel 32 further comprises a lock recess 323 that is positioned adjacent to the upper heel 31. The locking mechanism 40 comprises a release button 41, a button retainer 43, and a catch 42. The release button 41 is positioned adjacent to the lock recess 323 and is hingedly connected to the lower heel 32, such that the release button 41 can pivot about a single axis. The button retainer 43 is adjacently connected to the release button 41 and is positioned within the lock recess 323. The button retainer 43 ensures that the release button 41 returns to the same position each time the release button 41 is pressed. In the preferred embodiment of the present invention, the button retainer 43 is a spring that acts on the release button 41 to provide a returning force. It is also possible for the button retainer 43 to be a magnet. If the button retainer 43 is a magnet, then a second magnet or a ferrous piece of metal is positioned within the upper heel 31 adjacent to the lock recess 323, such that the button retainer 43 is attracted to the second magnet or the ferrous piece of metal.

In further reference to FIG. 8 and FIG. 15, the catch 42 is adjacently connected to the release button 41. The upper heel 31 further comprises a lock notch 311 that is positioned adjacent to the heel pin 33 opposite the arch platform 10. The lock notch 311 is shaped to snuggly receive the catch 42. When the lower heel 32 is in the extended configuration, the catch 42 engages the lock notch 311 in order to secure the lower heel 32 to the upper heel 31. By pressing the lower half of the release button 41 into the lock recess 323, the catch 42 is disengaged from the lock notch 311 and the lower heel 32 can be positioned into the stowed configuration.

Figure 5:
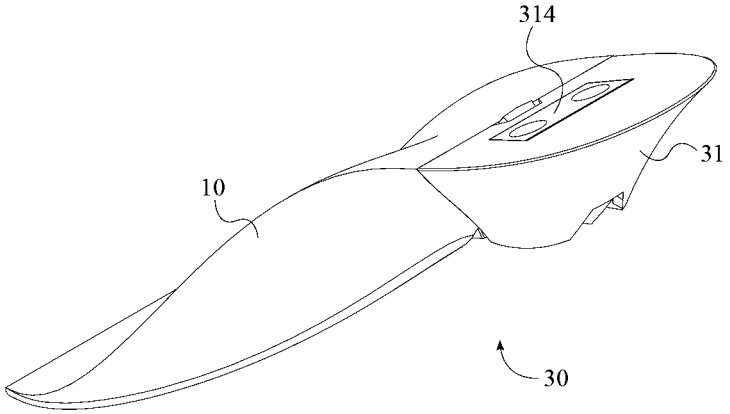
FIG. 5 is a perspective view showing the lower heel in the stowed configuration.

In order to transition the lower heel 32 from the extended configuration to the stowed configuration, the locking mechanism 40 is first disengaged in order to release the lower heel 32 from the upper heel 31. The lower heel 32 is then pulled downwards along the heel pin 33 until the nub 332 and pin guide 322 prevent the lower heel 32 from being slid any further, as shown in FIG. 3. The lower heel 32 is then rotated one hundred eighty degrees about the heel pin 33 as the nub 332 continues to follow the pin guide 322, as shown in FIG. 4. Once rotated, the lower heel 32 is slid upwards along the heel pin 33 until the nub 332 and the pin guide 322 do not permit the lower heel 32 to slide any further along the heel pin 33. The heel pin 33 is then rotated about the pin cradle 313 until the lower heel 32 is positioned within the heel recess 20, as shown in FIG. 5-6.

Figure 17:
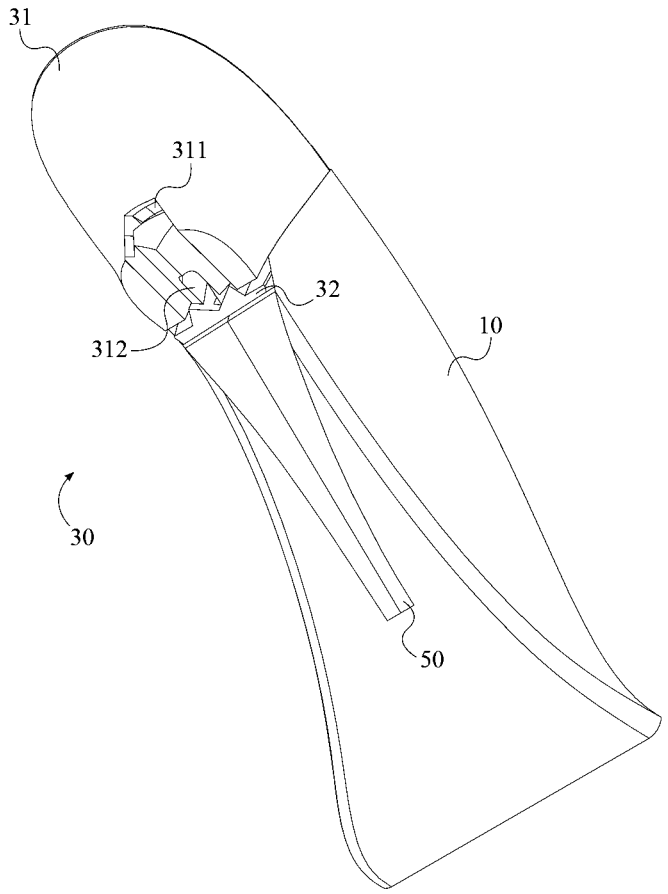
FIG. 17 is a perspective view of the lower heel positioned within the heel recess, behind a heel cover.

In an alternative embodiment of the present invention, the flat-to-heel convertible outsole further comprises a heel cover 50 that is adjacently connected to the arch platform 10, as shown in FIG. 17. The heel cover 50 is positioned adjacent to the heel recess 20, such that the heel cover 50 encloses the lower heel 32 within the heel recess 20 when the lower heel 32 is in the stowed configuration. Ideally, the heel cover 50 comprises two semi-rigid flaps connected to the arch platform 10 on opposite sides of the heel recess 20. The two flaps are flexible enough to permit passage of the lower heel 32 between the two flaps, yet rigid enough as to prevent small debris from entering the heel recess 20. Alternatively, the heel cover 50 can be a single piece that is snap fit into place, a single retractable cover piece, a single rotatable cover piece, etc.

Figure 18:
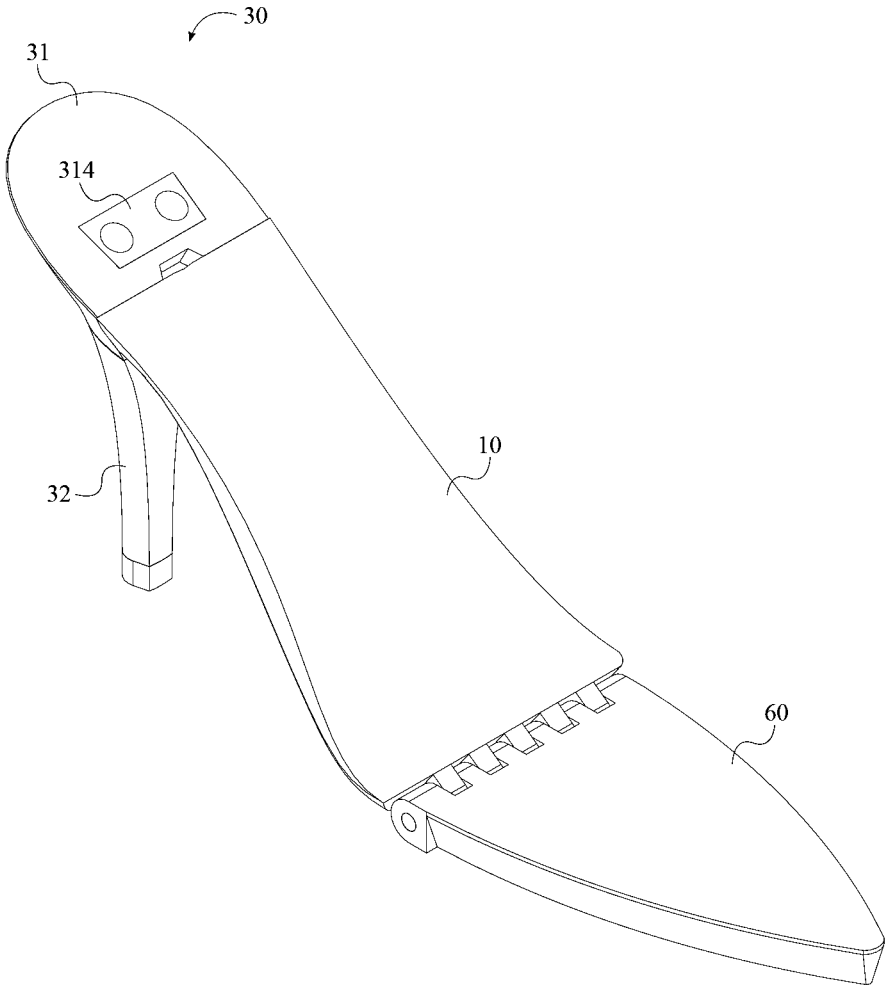
FIG. 18 is a perspective view of the present invention having a toe platform.

In another alternative embodiment of the present invention, the flat-to-heel convertible outsole further comprises a toe platform 60, as shown in FIG. 18. The toe platform 60 is hingedly connected to the arch platform 10 opposite the collapsible heel 30, such that the user's toes may rest flat when the lower heel 32 is in the stowed configuration. The arch platform 10 further comprises a plurality of arch extrusions, while the toe platform 60 comprises a plurality of toe extrusions. The plurality of toe extrusions is offset from the plurality of arch extrusions, such that the plurality of toe extrusions and the plurality of arch extrusions alternate to form a hinge joint when the toe platform 60 is connected to the arch platform 10. Alternatively, the toe platform 60 and the arch platform 10 may be seamlessly integrated together in order to form a single support structure with a flexible portion.

When formed into a complete shoe, an insole is positioned on the arch platform 10 and the upper heel 31 (and the toe platform 60 if included) opposite the outsole bottom surface 11. An upper is then connected to the arch platform 10 and the upper heel 31 (and the toe platform 60 if included) around the insole. The flat-to-heel convertible outsole can be connected to the upper using any method of connection known in the art of shoe making.

Figure 19:
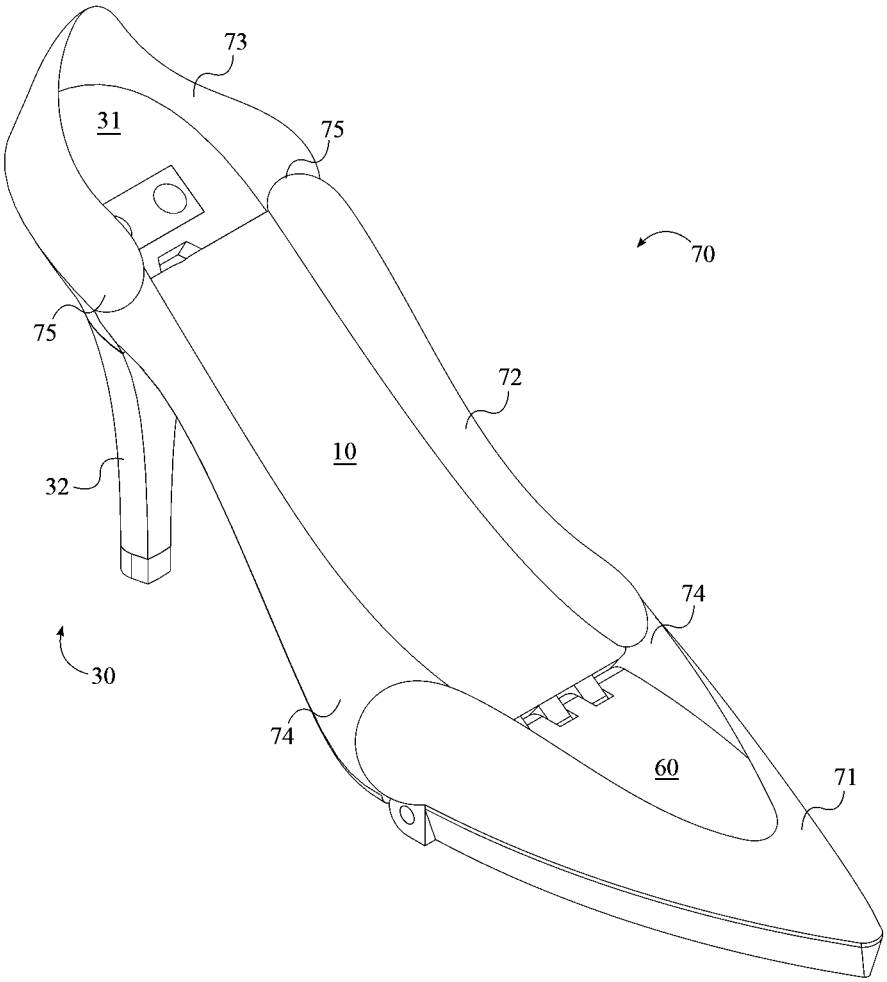
FIG. 19 is a perspective view of the present invention connected to an upper.

While a traditional upper can be used with the present invention, a traditional upper is not ideal as a traditional upper is a single piece of material that will crease when the present invention transitions between shoe styles. In reference to FIG. 19, ideally, an upper 70 that comprises a toe portion 71, an arch portion 72, a heel portion 73, a pair of front connectors 74, and a pair of rear connectors 75 is used with the present invention. The toe portion 71 and the heel portion 73 are positioned opposite each other along the arch portion 72, and both overlap the arch portion 72. The toe portion 71 is hingedly connected to the arch portion 72 by the pair of front connectors 74, while the heel portion 73 is hingedly connected to the arch portion 72 by the pair of rear connectors 75. In this way, there are not unwanted creases when the present invention transition between shoe styles. Preferably the pair of front connectors 74 and the pair of rear connectors 75 are elastic bands, however, other materials or mechanisms may be used.

Although the invention has been explained in relation to its preferred embodiment, it is to be understood that many other possible modifications and variations can be made without departing from the spirit and scope of the invention as hereinafter claimed.

What is claimed is:

1. A flat-to-heel convertible outsole comprising:

an arch platform having an outsole bottom surface and a heel recess;

a collapsible heel;

and a locking mechanism;

the collapsible heel comprising an upper heel, a lower heel, and a heel pin;

the upper heel being connected to the arch platform;

an upper portion of the heel pin being hingedly connected to the upper heel;

the lower heel being telescopically attached to a lower portion of the heel pin opposite the upper heel; the heel recess traversing through the outsole bottom surface into the arch platform and aligned with the collapsible heel, such that a portion of the collapsible heel is enclosed when folded into the heel recess in a stowed configuration;

the locking mechanism being connected to the lower heel and positioned adjacent to the upper heel, such that the locking mechanism binds the lower heel to the upper heel when the lower heel is in an extended configuration;

the upper heel comprising a pin cavity, a pin cradle, and a pin stop;

the pin cavity being positioned adjacent to the heel recess, forming an empty space in the upper heel through which the heel pin traverses;

the pin cradle being an annular cavity being positioned adjacent to the pin cavity;

the heel pin comprising a support arm; the support arm being an annular extrusion positioned perpendicular to a main shaft of the heel pin;

the support arm being positioned within the pin cradle, allowing the heel pin to pivot about a single axis;

the pin cradle or the support arm being ratcheted, regulating the rotation of the heel pin from the stowed configuration to the extended configuration or from the extended configuration to the stowed configuration;

the heel pin positioned within an opening in the upper heel;

the pin stop also positioned within the opening such that the pin stop covers the support arm of the heel pin;

the pin stop secured to the upper heel via screws, adhesive, or snap fit connection;

the lower heel comprising a pin channel and a pin guide;

the pin channel traversing along the lower heel;

the pin guide being positioned within the lower heel, adjacent to the pin channel;

the lower portion of the heel pin positioned within the pin channel and comprising a nub, such that the nub slidably engages the pin guide and limits movement of the lower heel along the heel pin; and the pin guide comprising a U-shaped track, the track allowing the lower heel to slide downwards along the heel pin, rotate 180 degrees, and slide upwards along the heel pin.

2. The flat-to-heel convertible outsole as claimed in claim 1, wherein:

the upper heel comprises a lock notch;

the locking mechanism comprises a release button and a catch;

the lock notch is positioned adjacent to the heel pin opposite the arch platform;

the catch is adjacently connected to the release button;

the release button is hingedly connected to the lower heel; and the catch engages the lock notch, wherein the lower heel is locked in an extended position.

3. The flat-to-heel convertible outsole as claimed in claim 1, wherein:

the lower heel comprises a lock recess;

the locking mechanism comprises a release button and a button retainer;

the lock recess is positioned adjacent to the upper heel;

the release button is hingedly connected to the lower heel;

the release button is positioned adjacent to the lock recess;

the button retainer is positioned within the lock recess; and the button retainer is adjacently connected to the release button.

4. The flat-to heel convertible outsole as claimed in claim 1, wherein:

the lower heel is positioned within the heel recess.

5. The flat-to heel convertible outsole as claimed in claim 1, further comprising:

a heel cover;

the heel cover being connected to the arch platform; and the heel cover being positioned adjacent to the heel recess.

6. The flat-to-heel convertible outsole as claimed in claim 1, wherein: the support arm and the nub are positioned opposite each other along the heel pin.

7. The flat-to heel convertible outsole as claimed in claim 1, further comprising:

a toe platform;

the toe platform being hingedly connected to the arch platform opposite the collapsible heel.

8. A flat-to-heel convertible outsole comprising:

an arch platform having an outsole bottom surface and a heel recess;

a collapsible heel;

and a locking mechanism;

the collapsible heel comprising an upper heel, a lower heel, and a heel pin;

the upper heel comprising a pin cavity, a pin cradle, and a pin stop;

the lower heel comprising a pin channel and a pin guide;

the heel pin comprising a support arm and a nub; the support arm being an annular extrusion positioned perpendicular to a main shaft of the heel pin; the support arm and the nub being positioned opposite each other along the heel pin;

the upper heel being connected to the arch platform;

an upper portion of the heel pin being hingedly connected to the upper heel;

the lower heel being telescopically attached to a lower portion of the heel pin opposite the upper heel;

the pin cavity being positioned adjacent to the heel recess, forming an empty space in the upper heel through which the heel pin traverses;

the pin cradle being an annular cavity being positioned adjacent to the pin cavity;

the support arm being positioned within the pin cradle, allowing the heel pin to pivot about a single axis;

the pin cradle or the support arm being ratcheted, regulating the rotation of the heel pin from the stowed configuration to the extended configuration or from the extended configuration to the stowed configuration;

the heel pin positioned within an opening in the upper heel;

the pin stop also positioned within the opening such that the pin stop covers the support arm of the heel pin;

the pin stop secured to the upper heel via screws, adhesive, or snap fit connection;

the pin channel traversing along the lower heel;

the pin guide being positioned within the lower heel, adjacent to the pin channel;

the lower portion of the heel pin positioned within the pin channel, such that the nub slidably engages the pin guide and limits movement of the lower heel along the heel pin;

the pin guide comprising a U-shaped track, the track allowing the lower heel to slide downwards along the heel pin, rotate 180 degrees, and slide upwards along the heel pin;

the locking mechanism being connected to the lower heel and positioned adjacent to the upper heel, such that the locking mechanism binds the lower heel to the upper heel when the lower heel is in an extended configuration; and the heel recess traversing through the outsole bottom surface into the arch platform and aligned with the collapsible heel, such that a portion of the collapsible heel is enclosed when folded into the heel recess in a stowed configuration.

9. The flat-to heel convertible outsole as claimed in claim 8, wherein:

the upper heel comprises a lock notch;

the locking mechanism comprises a release button and a catch;

the lock notch is positioned adjacent to the heel pin opposite the arch platform;

the catch is adjacently connected to the release button;

the release button is hingedly connected to the lower heel; and the catch engages the lock notch, wherein the lower heel is locked in an extended position.

10. The flat-to heel convertible outsole as claimed in claim 8, wherein:

the lower heel comprises a lock recess;

the locking mechanism comprises a release button and a button retainer;

the lock recess is positioned adjacent to the upper heel;

the release button is hingedly connected to the lower heel;

the release button is positioned adjacent to the lock recess;

the button retainer is positioned within the lock recess; and the button retainer is adjacently connected to the release button.

11. The flat-to heel convertible outsole as claimed in claim 8, wherein:

the lower heel is positioned within the heel recess.

12. The flat-to heel convertible outsole as claimed in claim 8, further comprising:

a heel cover;

the heel cover being connected to the arch platform; and the heel cover being positioned adjacent to the heel recess.

13. The flat-to heel convertible outsole as claimed in claim 8, further comprising:

a toe platform;

the toe platform being hingedly connected to the arch platform opposite the collapsible heel.

14. A flat-to-heel convertible outsole comprising:

an arch platform having an outsole bottom surface and a heel recess;

a collapsible heel; the collapsible heel comprising an upper heel, a lower heel, and a heel pin;

and a locking mechanism; the locking mechanism comprising a release button and a button retainer;

the upper heel comprising a pin cavity, a pin cradle, and a pin stop;

the lower heel comprising a pin channel, a pin guide, and a lock recess;

the heel pin comprising a support arm and a nub; the support arm being an annular extrusion positioned perpendicular to a main shaft of the heel pin; the support arm and the nub being positioned opposite each other along the heel pin;

the heel recess traversing through the outsole bottom surface into the arch platform and aligned with the collapsible heel, such that a portion of the collapsible heel is enclosed when folded into the heel recess in a stowed configuration;

the upper heel being connected to the arch platform and positioned adjacent the heel recess;

an upper portion of the heel pin being hingedly connected to the upper heel;

the pin cavity being positioned adjacent to the heel recess, forming an empty space in the upper heel through which the heel pin traverses;

the pin cradle being an annular cavity being positioned adjacent to the pin cavity;

the support arm being positioned within the pin cradle, allowing the heel pin to pivot about a single axis;

the pin cradle or the support arm being ratcheted, regulating the rotation of the heel pin from the stowed configuration to the extended configuration or from the extended configuration to the stowed configuration;

the heel pin positioned within an opening in the upper heel;

the pin stop also positioned within the opening such that the pin stop covers the support arm of the heel pin;

the pin stop secured to the upper heel via screws, adhesive, or snap fit connection;

the lower heel being telescopically attached to a lower portion of the heel pin opposite the upper heel;

the pin channel traversing along the lower heel;

the pin guide being positioned within the lower heel, adjacent to the pin channel;

the lower portion of the heel pin positioned within the pin channel, such that the nub slidably engages the pin guide and limits movement of the lower heel along the heel pin;

the pin guide comprising a U-shaped track, the track allowing the lower heel to slide downwards along the heel pin, rotate 180 degrees, and slide upwards along the heel pin;

the locking mechanism being connected to the lower heel and positioned adjacent to the upper heel, such that the locking mechanism binds the lower heel to the upper heel when the lower heel is in an extended configuration;

the release button being hingedly connected to the lower heel and positioned adjacent the lock recess; and the button retainer being positioned within the lock recess and adjacently connected to the release button.

15. The flat-to heel convertible outsole as claimed in claim 14, wherein:

the upper heel comprises a lock notch;

the locking mechanism comprises a catch;

the lock notch is positioned adjacent to the heel pin opposite the arch platform;

the catch is adjacently connected to the release button;

the release button is hingedly connected to the lower heel; and the catch engages the lock notch, wherein the lower heel is locked in an extended position.

16. The flat-to heel convertible outsole as claimed in claim 14, wherein:

the lower heel is positioned within the heel recess.

17. The flat-to heel convertible outsole as claimed in claim 14, further comprising:

a heel cover;

the heel cover being connected to the arch platform; and the heel cover being positioned adjacent to the heel recess.

18. The flat-to heel convertible outsole as claimed in claim 14, further comprising:

a toe platform;

the toe platform being hingedly connected to the arch platform opposite the collapsible heel.

* * * * *